United States Patent [19]

Jimenez

[11] 3,978,942

[45] Sept. 7, 1976

[54] PORTABLE WINDOW-ATTACHED EMERGENCY DESCENT MECHANISM

[76] Inventor: Ramon Jimenez, 1248 Silver Ave., San Francisco, Calif. 94134

[22] Filed: Apr. 17, 1975

[21] Appl. No.: 568,975

[52] U.S. Cl. ..... 182/75; 182/7; 182/142

[51] Int. Cl.[2] ..... A62B 1/08

[58] Field of Search ..... 182/7, 6, 5, 4, 3, 70, 182/73, 75, 142; 254/151, 154, 155, 156

[56] References Cited

UNITED STATES PATENTS

| | | | |
|---|---|---|---|
| 275,608 | 4/1883 | Drake | 254/154 |
| 512,899 | 1/1894 | Rawle | 182/142 |
| 731,352 | 6/1903 | Field | 254/154 |
| 1,073,293 | 9/1913 | Sideman | 182/142 |
| 2,194,978 | 3/1940 | Ireland | 182/55 |
| 2,544,964 | 3/1951 | Phelan | 182/7 |
| 3,306,582 | 2/1967 | Copeland | 254/154 |
| 3,315,762 | 4/1967 | Torrey | 182/206 |
| 3,696,888 | 10/1972 | Branderberger | 182/206 |

*Primary Examiner*—Reinaldo P. Machado
*Attorney, Agent, or Firm*—Townsend and Townsend

[57] ABSTRACT

A portable descent mechanism is disclosed which allows the use of a conventional window as an avenue of escape in emergency situations such as fires and comprising a passenger chair, spools with cable wound thereon, a brake, and window attachment apparatus designed for simple engagement with a conventional windowsill and utilizes a pair of hooks that fit over the windowsill.

5 Claims, 5 Drawing Figures

FIG _ 2
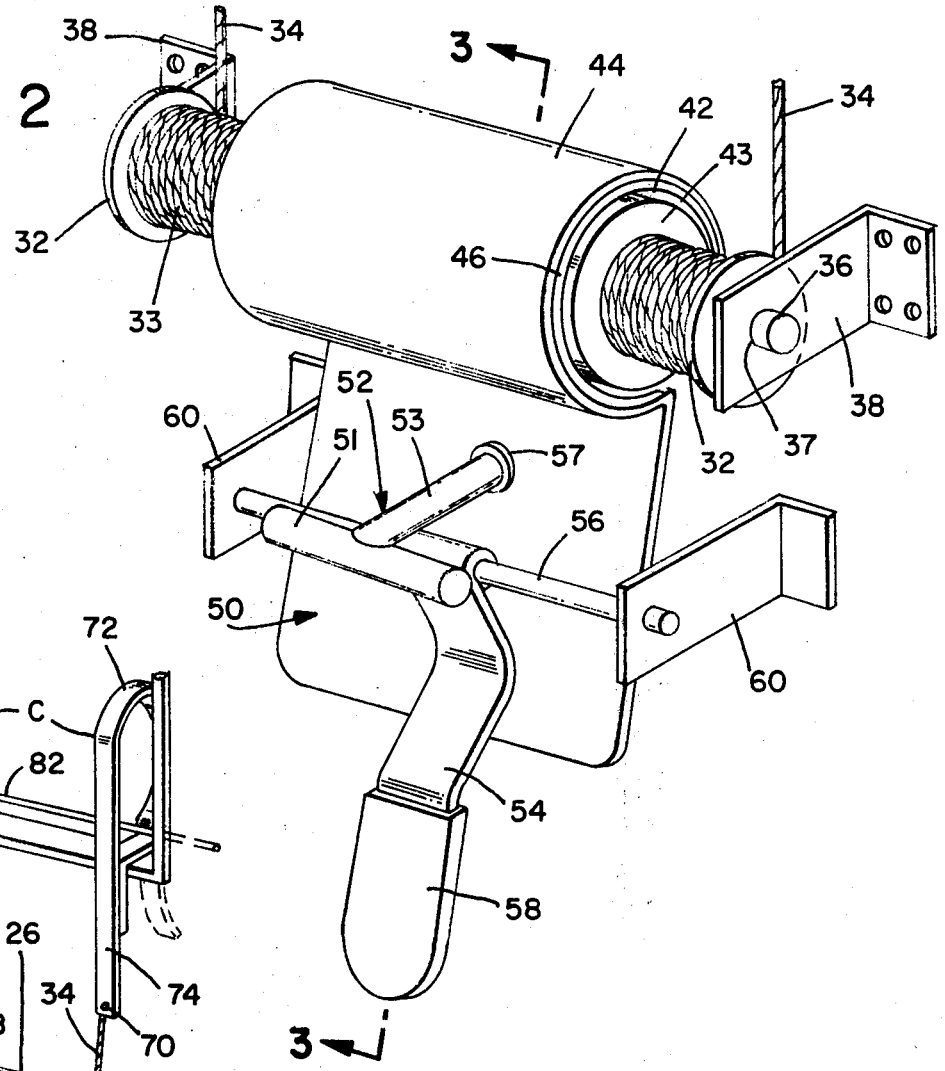
FIG _ 1
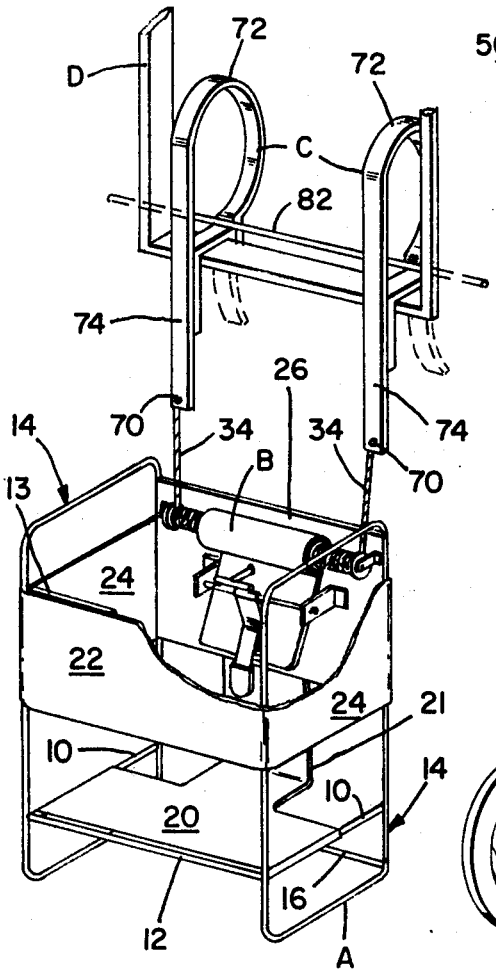
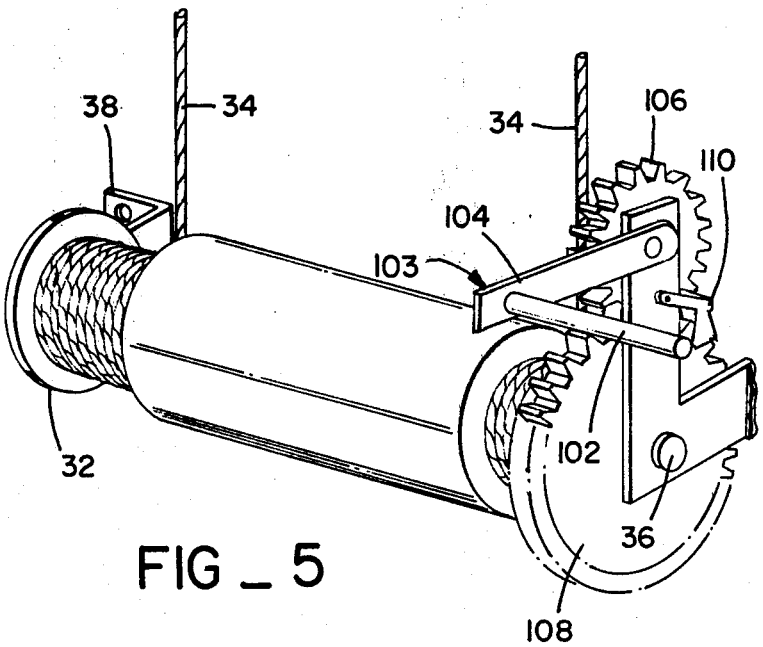
FIG _ 5

PORTABLE WINDOW-ATTACHED EMERGENCY DESCENT MECHANISM

BACKGROUND OF THE INVENTION

1. Field of the Invention

The invention contained herein relates to portable window-attached descent mechanisms for use in emergency situations.

2. Description of the Prior Art

Emergency descent mechanism in use today suffer from one or more deficiencies which make their use by one person difficult. For example, one type of emergency descent mechanism requires secure connection of a cable or band to the ground below the window to be used. This requires either the ground connection be made prior to use, thereby restricting use of the mechanism to one specific window, or someone at ground level to make the connection when the emergency arises. Other emergency descent mechanisms are fixedly attached to one particular window and may be rendered useless when the emergency precludes a person from reaching that window.

Further, many prior emergency descent mechanisms for use from a window have been, if not fixedly attached to one particular window, of such cumbersome construction that movement to a window as well as placement in the window is made exceedingly difficult.

Still other window-mounted emergency escape mechanism possess controls that are complex or are usable only by persons with a certain minimal level of physical ability. Thus, those who suffer from physical handicaps or the like may be precluded from using such devices when the occasion arises.

BRIEF SUMMARY OF THE INVENTION

A portable descent mechanism is disclosed which allows the use of a conventional window as an avenue of escape in emergency situations such as fires. The mechanism comprises a passenger chair, spools with cable wound thereon, a brake, and window attachment apparatus. The attachment apparatus is designed for simple engagement with a conventional windowsill and utilizes a pair of hooks that fit over the windowsill. Fixably attached to the hooks is a horizontal crossbar positioned on the hooks so as to remain inside the building with its ends extending beyond the window sides when the attachment apparatus is in place in a window. Cables are attached to each hook and extend therefrom to play-out spools attached to the passenger chair. The cables are wound upon and connected to the play-out spools so that during descent the cable is played out from each spool. The brake regulates play-out spool rotation during the descent of the passenger chair, thereby controlling the rate of descent, and is comprised of a brake band that substantially wraps around and frictionally engages the outer surface of a cylindrical brake drum. Two brake controls, that conveniently confront a passenger when in the passenger seat, are provided to allow the passenger to vary frictional engagement between the brake band band and brake drum to effect braking. The first brake control is a threaded handle which, when tightened, provides sufficient frictional engagement between the brake band and brake drum to lock the brake and hold the passenger chair in a non-descending position. Loosening the threaded handle control provides a deliberate release of the frictional engagement between the brake band and brake drum thereby allowing controlled descent of the passenger chair. The second brake control is used to override the first brake control for slowing or quick stopping as needed. An alternate embodiment provides a crank handle which allows both raising and lowering of the chair when suspended from the attachment hooks.

Therefore, an object of this invention is to disclose an emergency descent mechanism that may be quickly and easily attached to a variety of windows. According to this aspect of the invention, attachment hooks are provided having a hook-like curve sufficient to fit a variety of windowsill widths. Further, a horizontal crossbar is attached to the hooks such that when the attachment hooks are placed upon a windowsill the crossbar remains interior of the window and, by reason of its placement upon the hooks, provides additional holding by extending beyond the window sides.

An advantage of using attachment hooks is that the device may thereby be used from a variety of windows. Further, use of the descent device in a variety of windows thereby provides an equal variety of avenues of escape from a building. The user of the mechanism is limited only to those specific windows he can reach.

An advantage of using the horizontal crossbar, in combination with the attachment hooks, is that attachment to a windowsill may be hurriedly accomplished with little danger of dropping the entire device out the window. Attachment may be quickly and easily accomplished under the adverse conditions normally attendant with the required use of this invention, such as smoke, lack of lighting and/or stress. Having the crossbar ends extend substantially beyond both sides of the window allows the user to attach the mechanism to a windowsill with a minimum amount of effort and care. Merely placing the bar on the inner wall surfaces adjacent the window sides and allowing the attachment hooks to fall downwards is essentially all that is required for attachment.

A further advantage of this aspect of the invention is that such attachment takes no great physical ability or special tools to attach the attachment apparatus to a window.

A further object of this invention is to disclose a passenger chair that contains a passenger as well as providing a seat during descent. According to this aspect of the invention the passenger chair is provided with canvas back and side panels, a canvas seat, and a heat-reflecting sheet metal front surface which confronts the surface of the structure from which a user is descending and acts as a heat shield. The result is that a user, once situated in a seated position in the device facing the metal surface, is essentially contained within the descent device.

An advantage of such containment is that the danger of falling out of the device during descent is minimized.

A further advantage of this containment feature is that the user is instilled with a certain amount of confidence to enable him to use the device. This is particularly true when descent is to be made from a window located substantially above ground level.

A further advantage of this aspect of the invention is that the heat resistant front panel provides the passenger with a heat shield. Further, the passenger's legs remain free to allow him to kick himself away from the building during descent and bypass burning areas of the structure from which he is descending.

A further object of this invention is to provide brake controls, for controlling descent rate, that are conveniently located and easily used by a passenger when seated in the passenger chair. According to this aspect of the invention, two descent controls are positioned on the front metal panel so as to confront the passenger when he is seated in the passenger chair. The first brake control is a threaded handle control which, when in the threaded-in position, causes sufficient frictional engagement between the brake band and brake drum to prevent descent, thereby holding the chair in a non-descending attitude. Turning the threaded handle in one direction will allow release of this frictional engagement thereby allowing the chair to descend. A second brake control, an arcuate handle, is provided which operates to override the threaded handle control to decrease or stop the rate of descent of the passenger chair.

An advantage of this aspect of the invention is that the threaded handle control provides deliberate initiation of descent. Rotation of the threaded handle allows gradual release of the frictional engagement between the brake band and the brake drum thereby initiating descent at a gradually increasing rate. Descent is not initiated by release of a stop or the like thereby causing an abrupt drop which could cause an already panic-filled passenger into improperly controlling of the rate of descent.

A further advantage of this aspect is that once a desired rate of descent is achieved, that rate may be varied gradually by the threaded handle control or abruptly by arcuate handle control. Thus, as ground level is approached the arcuate handle control may be used to achieve the desired rate for reaching the ground, with a minimum of impact.

A further advantage of this aspect of the invention is that placement of the controls is such that a person, operating under the adverse circumstances attendant with emergency situations, can easily find and use them. Use of the controls requires no special physical movement such as reaching or the like. Additionally, controls are placed so as to minimize clothing being caught thereon during use.

BRIEF DESCRIPTION OF THE DRAWINGS

FIG. 1 is a perspective view illustrating the descent mechanism attached to a window ready for occupancy and descent;

FIG. 2 is a perspective view of the play-out spools, the brake, and the two brake controls;

FIG. 5 is a perspective view of yet another embodiment of descent control.

DETAILED DESCRIPTION OF THE PREFERRED EMBODIMENT

Figure 3:
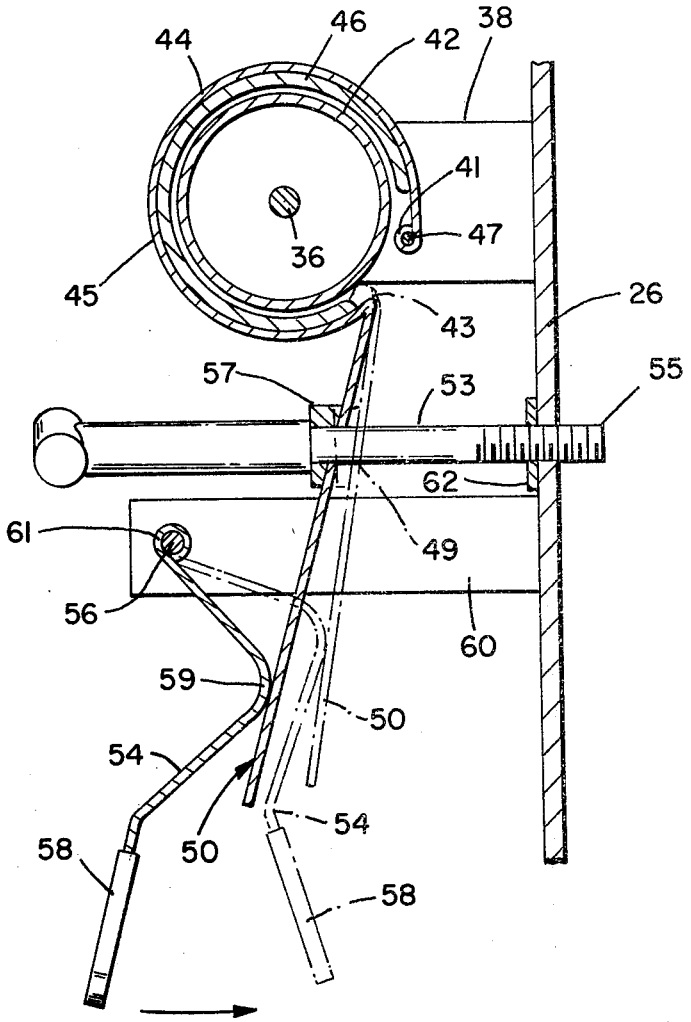
FIG. 3 is a side elevation view of the brake and its controls taken along the lines 3—3 of FIG. 2 and depicting, in broken lines, the use of the arcuate handle control.

Referring to FIG. 1, the portable descent mechanism, comprising the passenger chair A, the brake B, and attachment apparatus C, is shown attached to a window D in a pre-descent attitude and ready for occupancy. As can be seen, the frame of the passenger chair A has two substantially rectangular side members 14. The side members 14 are held in a spaced apart relationship by the back bars 12, 13, the lower front bar 16, and the front panel 26. Preferably, the frame members are fashioned from three-quarter inch aluminum tubing. The front panel 26, is preferably made from a one-eighth inch aluminum sheet.

Attached to the side bars 10, and extending from one to the other, is seat 20, preferably of a canvas material, with a front strap 21 extending therefrom and attached to the front plate 26.

The side panels 24, 24, and the back panel 22 are comprised of a single canvas sheet one end of which is attached to the side of front panel 26 and extended around the two side members 14, 14 with the other end of the canvas sheet attached to the other side of front panel 26 thereby creating the side panels 24, 24 and the back panel 22.

Located on the front panel 26, positioned to confront a passenger when seated in the passenger chair A, is the brake B which controls the rate of descent of the passenger chair A. Referring to FIG. 2, it can be seen that the brake B is positioned between, and fixedly connected to, the two play-out spools 32, 33 and comprises an elongate cylindrical brake drum 42, having side enclosures 43, 43 at each end of the brake drum 42. Substantially surrounding the brake drum 42 is the brake band 44. In the interstitial area between brake band 44 and brake drum 42 and fixedly attached to the brake band 44 is a brake material 46. Preferably, the brake material 46 is a commercially available asbestos material of the type normally used to enhance frictional engagement with a metallic surface such as in automobile braking systems. As FIGS. 2 and 3 illustrate, the brake band 44 is formed from a flat metal sheet. Approximately one-half the sheet is used to form the arcuate bend 45 encompassing the brake drum 40. At one end of the bend 45 an eyelet 41 is fashioned through which a shaft 47 is fitted to provide pivotal connection of the brake band 44. At the other end of the bend 45 of the metal sheet is a sharp arcuate bend 43 which causes the remainder of the flat metal sheet to extend away from the brake band 45 to form a tongue 50.

The brake drum 42 of brake B is journaled on the shaft 36. Fixedly attached to the side enclosures 43, 43 of, and in axial alignment with, the brake drum 42 are play-out spools 32, 33, also journaled on shaft 36. Rotation of the play-out spools, caused by cables 34, 34 being played out therefrom during descent, will be controlled by brake B. The shaft 36 is journaled in the bearings 37, 37 in mounting members 38, 38 positioned adjacent each play-out spool. Mounting members 38, 38 are connected to the front panel 26.

Frictional engagement between the brake band 44 and the brake drum 42 is first effected by the threaded control handle 52 which comprises handle 51, a shaft 53, shoulder 57, and threaded end 55. The threaded control handle 52 passes through an opening 49 of the brake band tongue 50. The threaded end 55 of the threaded control handle 52 is threaded into and through a nut 62 attached to the front panel 26. The frictional engagement between the brake band 44 and the brake drum 42 may also be effected by the arcuate central bar 54, which acts to override the control of the threaded handle 52 to increase said frictional engagement as explained below.

Referring now specifically to FIG. 3, control of the brake B through the use of threaded control handle 52 may be understood. As shown, rotating threaded control handle 52 in a clockwise direction will cause shoulder 57 to move toward the front plate 26. The shoulder 57 of the threaded handle control 52 engages the tongue 50 during this forward movement causing the brake band 44 to tighten around the brake drum 42 thereby increasing the frictional engagement between the brake band material 46 and the brake drum 42. Rotation of the brake drum 42, and the two play-out spools 32, 33 attached thereto, is thereby constrained or completely inhibited, depending upon the amount of frictional engagement created.

Conversely, turning the threaded control handle 52 in a counter-clockwise direction will move the shoulder 57 away from the front panel 26. This, in turn, allows the spring-like tension created in the brake band to relax, thereby decreasing the frictional engagement between the brake band 46 and the brake drum 42.

FIG. 3 also illustrates the action of the second control which is superimposed upon, and overrides, the threaded control handle. The second control has a handgrip 58 mounted on one end of the curved shaped arcuate control bar 54. At the other end of the curved control bar 54 is a hinge eye 61 for pivotal mounting of the control handle 54 to shaft 56.

Descent is initiated by a counter-clockwise turning of the threaded control handle 52 thereby releasing frictional engagement between the brake band 44 and the brake drum 42 allowing rotation of the brake drum 42 and play-out spools 32, 33. A passenger, seated in the passenger chair, confronts the controls of the brake B. Once descent has been initiated, such descent may be slowed or stopped by the passenger grasping, and pushing away from him, the control handle 58 of arcuate control bar 54. As can be seen, as the handle 58 of the control bar 54 is moved away from the passenger and towards the front plate 26 the arcuate surface 59 of the control bar 54 engages the brake tongue 50. The brake tongue 50 is thereby caused to move towards the front panel 26, guided by opening 49 along the threaded bolt shaft 53, increasing frictional engagement of the brake band 44 with the brake drum 42; a corresponding decrease in the rotation of brake drum 42, play-out spools 32, 33, and a decrease in the rate of descent results.

One end of each of cables 34, 34, which connect the passenger chair A to the attachment apparatus C, are securely fastened to and wound up on the play-out spools 32, 33. The other end of the cables 34, 34 connect to the attachment apparatus C at connection points 70.

Figure 4:
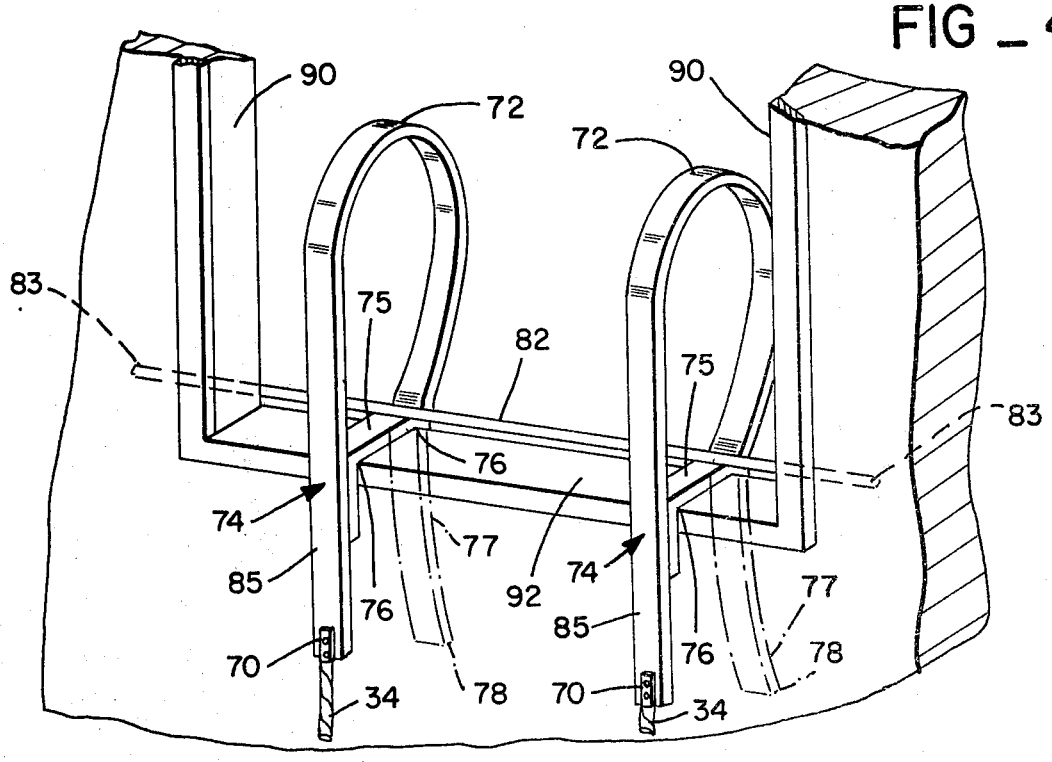
FIG. 4 is a perspective view of the attachment hooks and horizontal crossbar illustrating attachment to a window.

Referring now to FIGS. 1 and 4, attachment apparatus C may now be described and understood. As illustrated, attachment apparatus C comprises the window hooks 74, 74 with the horizontal crossbar 82 fixedly attached thereto. Window hook 74 is fashioned from a single straight member by creating the straight portion 85 which extends from the cable attachment point 70 to the first arcuate bend 76, a second shorter top portion 75 extending between two arcuate bends 76, 76, a third curved member 77 extending from the second arcuate bend 76 to the hook tip 78. As can be seen in FIG. 4, the hook tip 78 bends slightly outward from the hook itself. This outward bend of hook tip 78 facilitates placement of the hooks 74, 74 upon a windowsill, such as windowsill 92 depicted in FIG. 4. Attachment hooks 74, 74 additionally have affixed thereto support members 72, 72 to aid in allowing entry into the passenger chair A when suspended in a pre-descent position outside a window.

The horizontal crossbar 82 is fastened at a point on the hooks 74, 74 so as to allow the horizontal crossbar 82 to remain interior of the window D when the attachment apparatus C is mounted in a window. When so mounted, the horizontal crossbar ends 83, 83 extend beyond the window sides 90, 90 of the window D.

Referring now to FIG. 5, an alternate control for varying descent rate of the passenger chair is illustrated. This control comprises the parallel spur gears 106, 108, a crank 103, and the pivotally mounted pawl 110. The spur gear 108 is fixedly attached to the outer rim of play-out spool 32. The pawl 110 is pivotally mounted adjacent spur gear 108 and adapted to fall into the interdental spaces of the spur gear 108 so as to permit rotation in only one direction when so engaged. Fixedly mounted to the spur gear 106 is the crank 103 having a crank arm 104 and a handle 102.

In operation, this alternate control can be used to provide the passenger chair A with either descent or ascent control. To operate as a descent control, the pawl 110 is first disengaged from spur gear 108 to allow rotation thereof. Next, the threaded handle 52 is rotated counter-clockwise to loosen the frictional engagement of the brake band 44 and the brake drum 42, to initiate descent. During such descent, the brake drum 42 and play-out spools 32, 33 will rotate as cables 34, 34 play-out from the spools 32, 33. This rotation will also cause spur gears 108, 106, and crank 103 to rotate. The passenger, by grasping crank handle 102, can exert a force counter to rotation of the crank 103 which, through the spur gears 106, 108, will inhibit rotation of the play-out spools 32, 33; a decrease in the rate of descent results. Alternately, the passenger may exert a force concomitant with crank 103 rotation thereby increasing the rotation and the descent rates.

To use the alternate control in the ascent mode, the pawl 110 is disposed so as to engage spur gear 108. When so engaged, rotation of the spur gear 108 in the counter-clockwise direction and, therefore, descent is inhibited. The passenger may then rotate the crank 103 in a clockwise direction which, through spur gear 106, rotates 108 and play-out spools 32, 33 in a clockwise direction thereby causing the cables 34, 34 to be wound upon the play-out spools; ascent of the passenger chair A is achieved.

It should be appreciated that this invention is capable of modification. For example, while two hooks and two cables have here been shown, any number of cables or hooks could be used. Moreover, the parts of the passenger chair here illustrated are preferably constructed out of aluminum. Other modifications can obviously be made without departing from the spirit and scope of this invention.

I claim:

1. A portable descent mechanism for descending from a window, having sides defining a first width, to a ground level in emergency situations comprising:

at least a pair of attachment hooks for attachment to said window, said attachment hooks having affixed thereto a horizontal crossbar with ends separated by a length greater than the width of the window, said crossbar disposed upon said hooks such that when said hooks are attached to the window said crossbar remains interior of the window with said crossbar ends extending beyond the sides of the window;

a pair of cables connected to said hooks;

means for carrying a passenger during descent from the window to the ground level;

a pair of spools mounted upon said passenger means and having said cables connected thereto and wound thereon, said spools adapted to play out said cables during descent of said passenger means;

braking means connected to said spools and having a first brake control for initiating and permitting descent at a pre-selected rate and a second brake control that overrides said first brake control to decrease the rate of descent from the pre-selected rate;

a first gear fixedly attached to one of said spools;

a second gear disposed to engage said first gear;

means to selectively engage at least one of said gears such that when so engaged rotation of said spool in a direction permitting descent is prohibited; and a crank handle connected to said second gear for rotation of said second gear such that turning said crank in one direction allows said passenger means to ascend from the ground level.

2. The portable descent mechanism of claim 1, including:

support means mounted to said attachment hooks for providing a user of said descent mechanism with support when climbing into said passenger chair.

3. The portable descent mechanism of claim 1, wherein said braking means comprises:

an elongate cylindrical brake drum; and a brake band substantially surrounding said brake drum and disposed so as to frictionally engage the outer cylindrical surface of said brake drum.

4. The portable descent mechanism of claim 3, wherein said first brake control comprises:

a rotatable handle coupled to said brake band such that when said handle is rotated in one direction frictional engagement between said brake band and said brake drum is decreased and rotation of said play-out spool is allowed.

5. The portable descent mechanism of claim 3, wherein said second brake control comprises:

an override handle positioned outwardly towards the rider such that descent of said passenger chair is decreased when said override handle is disposed away from the rider.

* * * * *